US007028674B2

(12) United States Patent
Veinotte

(10) Patent No.: US 7,028,674 B2
(45) Date of Patent: Apr. 18, 2006

(54) FLOW SENSOR INTEGRATED WITH LEAK DETECTION FOR PURGE VALVE DIAGNOSTIC

(75) Inventor: Andre Veinotte, Dresden (CA)

(73) Assignee: Siemens VDO Automotive Inc., Chatham (CA)

( * ) Notice: Subject to any disclaimer, the term of this patent is extended or adjusted under 35 U.S.C. 154(b) by 321 days.

(21) Appl. No.: 10/758,239

(22) Filed: Jan. 16, 2004

(65) Prior Publication Data

US 2005/0005917 A1 Jan. 13, 2005

Related U.S. Application Data

(60) Provisional application No. 60/456,419, filed on Mar. 21, 2003, provisional application No. 60/440,829, filed on Jan. 17, 2003.

(51) Int. Cl.
*F02M 33/04* (2006.01)

(52) U.S. Cl. ..... 123/518; 123/519; 123/520

(58) Field of Classification Search ..... 123/516, 123/518, 519, 520
See application file for complete search history.

(56) References Cited

U.S. PATENT DOCUMENTS

| | | | | |
|---|---|---|---|---|
| 322,084 | A | | 7/1885 | Wilder |
| 2,204,706 | A | | 6/1940 | Searle |
| 2,318,962 | A | | 5/1943 | Parker |
| 2,679,946 | A | | 6/1954 | Friend |
| 3,413,840 | A | | 12/1968 | Basile et al. |
| 3,741,232 | A | | 6/1973 | Soberski |
| 4,368,366 | A | | 1/1983 | Kitamura et al. |
| 4,819,607 | A | | 4/1989 | Aubel |
| 4,842,015 | A | | 6/1989 | Haak et al. |
| 4,926,825 | A | | 5/1990 | Ohtaka et al. |
| 4,949,695 | A | * | 8/1990 | Uranishi et al. ..... 123/520 |
| 4,951,701 | A | | 8/1990 | Boehmer |
| 4,962,744 | A | * | 10/1990 | Uranishi et al. ..... 123/520 |
| 5,021,071 | A | | 6/1991 | Reddy |
| 5,036,823 | A | | 8/1991 | MacKinnon |
| 5,088,466 | A | * | 2/1992 | Tada ..... 123/519 |

(Continued)

FOREIGN PATENT DOCUMENTS

WO WO-91/12426 8/1991

(Continued)

OTHER PUBLICATIONS

U.S. Appl. No. 10/758,273, filed Jan. 16, 2004, Veinotte, et al., Flow Sensor for Purge Valve Diagnostic.

(Continued)

*Primary Examiner*—Thomas Moulis

(57) ABSTRACT

An apparatus and a method for managing fuel vapor pressure in a fuel system that supplies fuel to an internal combustion engine. The fuel vapor pressure management apparatus performs leak detection on a headspace of the fuel system, performs excess negative pressure relief of the headspace, performs excess positive pressure relief of the headspace, and performs a diagnostic on the purge valve. The apparatus includes a housing, a pressure operable device, and a printed circuit board. The housing defines an interior chamber. The pressure operable device separates the interior chamber into first and second portions. And the pressure operable device includes a poppet that moves along an axis and a seal that is adapted to cooperatively engage the poppet. The printed circuit board is supported by the housing in the interior chamber. And the printed circuit board includes a first sensor that is adapted to be actuated by movement of the poppet along the axis and a second sensor that measures a flow rate within the housing.

40 Claims, 9 Drawing Sheets

U.S. PATENT DOCUMENTS

| | | | | | |
|---|---|---|---|---|---|
| 5,105,789 | A | | 4/1992 | Aramaki et al. | |
| 5,113,834 | A | * | 5/1992 | Aramaki | 123/520 |
| 5,116,257 | A | | 5/1992 | Szlaga | |
| 5,143,035 | A | * | 9/1992 | Kayanuma | 123/198 D |
| 5,146,902 | A | * | 9/1992 | Cook et al. | 123/518 |
| 5,150,689 | A | * | 9/1992 | Yano et al. | 123/519 |
| 5,158,054 | A | * | 10/1992 | Otsuka | 123/198 D |
| 5,191,870 | A | * | 3/1993 | Cook | 123/520 |
| 5,224,511 | A | | 7/1993 | Schnettler | |
| 5,253,629 | A | | 10/1993 | Fornuto et al. | |
| 5,263,462 | A | * | 11/1993 | Reddy | 123/520 |
| 5,295,472 | A | * | 3/1994 | Otsuka et al. | 123/520 |
| 5,373,822 | A | | 12/1994 | Thompson | |
| 5,449,018 | A | | 9/1995 | Harris | |
| 5,524,662 | A | | 6/1996 | Benjey et al. | |
| 5,679,890 | A | * | 10/1997 | Shinohara et al. | 73/118.1 |
| 5,863,025 | A | | 1/1999 | Noya | |
| 5,911,209 | A | * | 6/1999 | Kouda et al. | 123/520 |
| 6,328,021 | B1 | | 12/2001 | Perry et al. | |
| 6,450,152 | B1 | | 9/2002 | Everingham | |
| 6,460,566 | B1 | | 10/2002 | Perry et al. | |
| 6,478,045 | B1 | | 11/2002 | Perry | |
| 6,564,780 | B1 | | 5/2003 | Hanai et al. | |

FOREIGN PATENT DOCUMENTS

| | | |
|---|---|---|
| WO | WO-01/38716 | 5/2001 |

OTHER PUBLICATIONS

U.S. Appl. No. 10/758,272, filed Jan. 16, 2004, Veinotte, et al., Flow Sensor for Purge Valve Diagnostic.

U.S. Appl. No. 10/758,238, filed Jan. 16, 2004, Veinotte, Flow Sensor Integrated with Leak Detection for Purge Valve Diagnostic.

U.S. Appl. No. 10/736,773, filed Dec. 17, 2003, Perry, et al., Apparatus, System and Method of Establishing a Test Threshold for a Fuel Vapor Leak Detection System.

U.S. Appl. No. 10/170,420, filed Jun. 16, 2002, Veinotte, Apparatus and Method for Preventing Resonance in a Fuel Vapor Pressure Management Apparatus.

U.S. Appl. No. 10/667,903, filed Sep. 23, 2003, Veinotte, et al., Rationality Testing for a Fuel Vapor Pressure Management Apparatus.

U.S. Appl. No. 10/667,902, filed Sep. 23, 2003, Perry, et al., In-Use Rate Based Calculation for a Fuel Vapor Pressure Management Apparatus.

U.S. Appl. No. 10/171,469, filed Jun. 14, 2002, Veinotte, et al., A method of Managing Fuel Vapor Pressure in a Fue System.

U.S. Appl. No. 10/171,470, filed Jun. 14, 2002, Veinotte, Bi-Directional Flow Seal for a Fuel Vapor Pressure Management Apparatus.

U.S. Appl. No. 10/669,963, filed Sep. 23, 2003, Veinotte, et al., Apparatus and Method of Changing Printed Circuit Boards in a Fuel Vapor Pressure Management.

U.S. Appl. No. 10/667,965, filed Sep. 23, 2003, Veinotte, Method of Designing a Fuel Vapor Pressure Management Apparatus.

U.S. Appl. No. 10/171,471, filed Jun. 14, 2002, Veinotte, Apparatus and Method for Calibrating a Fuel Management Apparatus.

U.S. Appl. No. 10/171,472, filed Jun. 14, 2002, Veinotte, A Poppet for a Fuel Vapor Pressure Management Apparatus.

U.S. Appl. No. 10/171,473, filed Jun. 14, 2002, Veinotte, Method for Fuel Vapor Pressure Management.

U.S. Appl. No. 10/170,395, filed Jun. 14, 2002, Veinotte, Apparatus for Fuel Vapor Pressure Management.

U.S. Appl. No. 10/170,397, filed Jun. 14, 2002, Veinotte, Fuel System Including an Apparatus for Fuel Vapor Pressure Management Apparatus.

OBDII Systems and Components, Siemens' Document, Aug. 28, 1992 16 pages.

Proposal for Pressure Testing the Evaporative System, (OBDII), Siemens' Document, May 11, 1992, 18 pages.

* cited by examiner

DETAIL B-1

FLOW SENSOR INTEGRATED WITH LEAK DETECTION FOR PURGE VALVE DIAGNOSTIC

CROSS REFERENCE TO RELATED APPLICATIONS

This application claims the benefit of the earlier filing date of U.S. Provisional Application Nos. 60/440,829, filed 17 Jan. 2003, and 60/ 456,419, filed 21 Mar. 2003, which are incorporated by reference herein in their entirety.

Co-pending U.S. application Ser. Nos. 10/170,397, 10/170,395, 10/171,473, 10/171,472, 10/171,471, 10/171, 470, 10/171,469, and 10/170,420, all of which were filed 14 Jun. 2002, are incorporated by reference herein in their entirety. Co-pending applications filed on Sep. 23, 2003 and identified as Ser. No. 60/412,556 ("Method Of Designing A Fuel Vapor Pressure Management Apparatus"), Ser. No. 60/412,578 ("In-Use Rate Based Calculation For A Fuel Vapor Pressure Management Apparatus"), Ser. No. 60/412, 577 ("Rationality Testing For A Fuel Vapor Pressure Management Apparatus"), and Ser. No. 10/758,272 ("Apparatus and Method of Changing Printed Circuit Boards in a Fuel Vapor Pressure Management Apparatus") are incorporated by reference herein in their entirety.

Related co-pending applications filed concurrently herewith are identified as Ser. No. 10/758,238 ("Flow Sensor Integrated with Leak Detection for Purge Valve Diagnostic"), Ser. No. 10/758,272 ("Flow Sensor for Purge Valve Diagnostic"), and Ser. No. 10/758,273 ("Flow Sensor for Purge Valve Diagnostic") all of which are incorporated by reference herein in their entirety.

FIELD OF THE INVENTION

A fuel vapor pressure management apparatus and method that performs a leak diagnostic and detects fuel vapor in a fuel system. In particular, a fuel vapor pressure management apparatus and method that vents positive pressure, vents excess negative pressure, and detects a flow rate during engine runtime as a diagnostic for proper functioning of a canister purge valve.

BACKGROUND OF THE INVENTION

Conventional fuel systems for vehicles with internal combustion engines can include a canister that accumulates fuel vapor from a headspace of a fuel tank. If there is a leak in the fuel tank, the canister, or any other component of the fuel system, fuel vapor could escape through the leak and be released into the atmosphere instead of being accumulated in the canister. Various government regulatory agencies, e.g., the U.S. Environmental Protection Agency and the Air Resources Board of the California Environmental Protection Agency, have promulgated standards related to limiting fuel vapor releases into the atmosphere. Thus, it is believed that there is a need to avoid releasing fuel vapors into the atmosphere, and to provide an apparatus and a method for performing a leak diagnostic, so as to comply with these standards. Emission standards also stipulate that the performance of each emission control device be monitored (e.g., a canister purge valve).

In such conventional fuel systems, excess fuel vapor can accumulate immediately after engine shutdown, thereby creating a positive pressure in the fuel vapor pressure management system. Excess negative pressure in closed fuel systems can occur under some operating and atmospheric conditions, thereby causing stress on components of these fuel systems. Thus, it is believed that there is a need to vent, or "blow-off," the positive pressure, and to vent, or "relieve," the excess negative pressure. Similarly, it is also believed to be desirable to relieve excess positive pressure that can occur during tank refueling. Thus, it is believed that there is a need to allow air, but not fuel vapor, to exit the tank at high flow rates during tank refueling. This is commonly referred to as onboard refueling vapor recovery. (ORVR).

When the engine is not running, excessive fuel vapor is typically stored in a canister that contains charged charcoal for trapping the hydrocarbons. Fuel vapor stored within this canister is recovered when the engine is running by airflow through the canister resulting from the engine intake vacuum. A canister purge valve is located between the canister and engine intake to regulate the amount of fuel vapor drawn into the engine. If there is excess fuel vapor upstream of the canister purge valve, as a possible result of the purge valve not regulating the flow of fuel vapor as indicated, then excessive vapor can build up and possibly leak into the atmosphere, thereby giving rise to environmental contamination concerns.

SUMMARY OF THE INVENTION

The invention provides a fuel vapor detection apparatus and method for a fuel system of an internal combustion engine. When the engine is running, the fuel vapor detection apparatus performs a flow check in the area upstream of the canister purge valve. The apparatus may also be used to detect leaks in a fuel system when the engine is not running. The apparatus includes a purge valve located upstream of an engine intake manifold; a fuel vapor containment canister located upstream of the purge valve; a fuel vapor management device located upstream of the canister, including a housing defining an interior chamber, and the interior chamber containing a valve separating the interior chamber into first and second portions; and a circuit board within one of the first and second portions, the circuit board including a first and second sensor; wherein the first sensor is adapted for being actuated by motion of the valve as part of a leak detection diagnostic; and wherein the second sensor is configurable between a first temperature sensor adapted for measuring temperature as part of the leak detection diagnostic, and a second temperature sensor adapted for measuring a flow rate as part of a purge valve diagnostic.

The present invention also provides a method of performing a leak diagnostic when the engine is off, and method for diagnosing a purge valve when the engine is running in a fuel system for an internal combustion engine. The method includes providing a fuel vapor management apparatus including a housing defining an interior chamber and a valve separating the interior chamber into first and second portions; positioning the fuel vapor pressure management apparatus upstream of a fuel vapor collection canister and an engine intake manifold; providing a circuit board including a pressure and temperature sensor, the circuit board being located in one of the first and second portions; when the engine is off, measuring the temperature and pressure of the fuel vapor using the temperature and pressure sensor and, based on the measured temperature and pressure, determining whether there is a leak in the system; and when the engine is running, performing a purge valve diagnostic step including the step of measuring a temperature using the temperature sensor and concluding, based on the measured temperature, whether the purge valve is working properly.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

As it is used in this description, "atmosphere" generally refers to the gaseous envelope surrounding the Earth, and "atmospheric" generally refers to a characteristic of this envelope.

As it is used in this description, "pressure" is measured relative to the ambient atmospheric pressure. Thus, positive pressure refers to pressure greater than the ambient atmospheric pressure and negative pressure, or "vacuum," refers to pressure less than the ambient atmospheric pressure.

Also, as it is used in this description, "headspace" refers to the variable volume within an enclosure, e.g. a fuel tank, that is above the surface of the liquid, e.g., fuel, in the enclosure. In the case of a fuel tank for volatile fuels, e.g., gasoline, vapors from the volatile fuel may be present in the headspace of the fuel tank.

Figure 1:
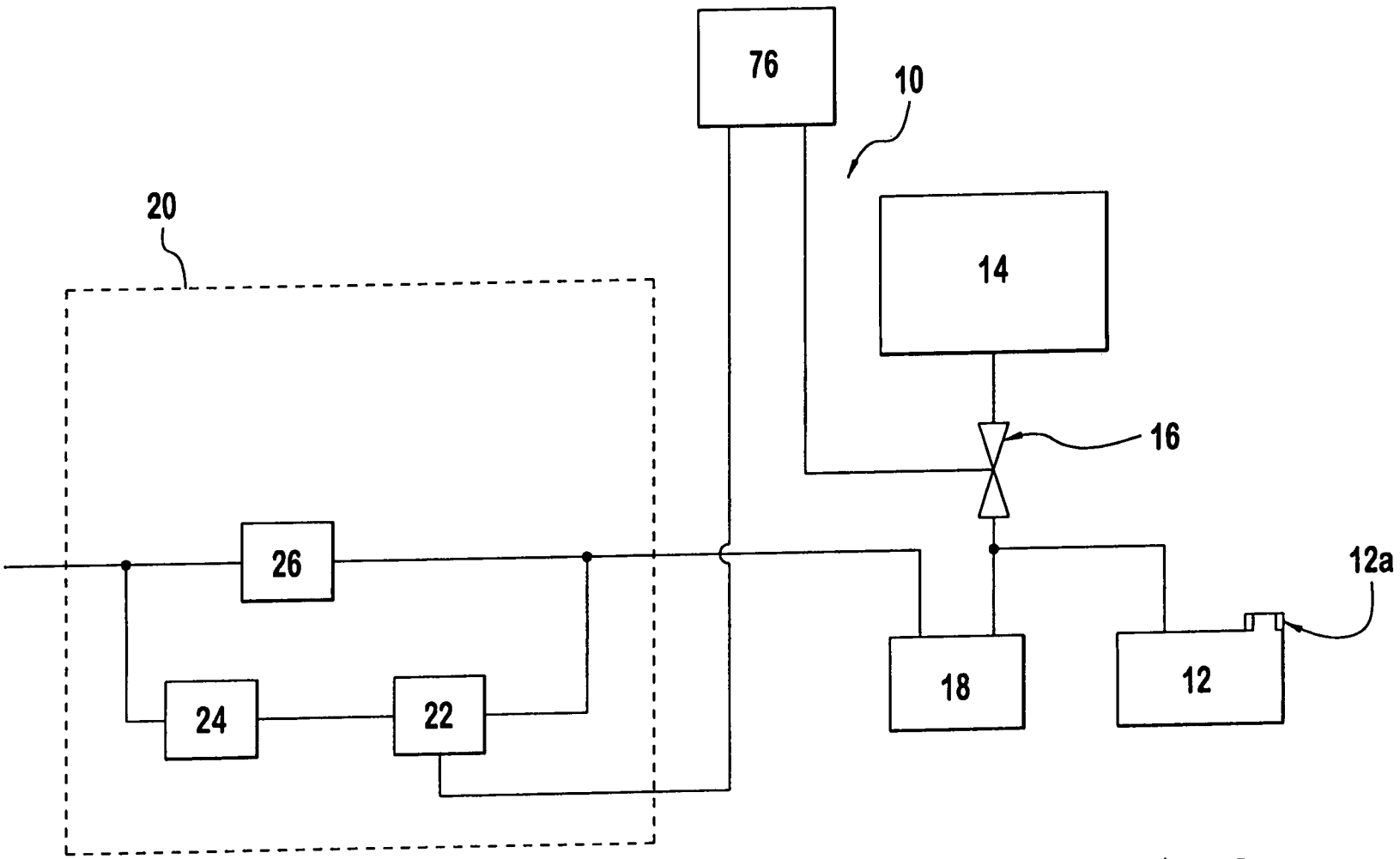
FIG. 1 is a schematic illustration of a fuel system, in accordance with the detailed description of the preferred embodiment, which includes a fuel vapor pressure management apparatus.

Referring to FIG. 1, a fuel system 10, e.g., for an engine (not shown), includes a fuel tank 12, a vacuum source 14 such as an intake manifold of the engine, a purge valve 16, a charcoal canister 18, and a fuel vapor pressure management apparatus 20.

The fuel vapor pressure management apparatus 20 performs a plurality of functions including signaling 22 that a first predetermined pressure (vacuum) level exists, "vacuum relief" or relieving negative pressure 24 at a value below the first predetermined pressure level, and "pressure blow-off" or relieving positive pressure 26 above a second pressure level.

Other functions are also possible. For example, the fuel vapor pressure management apparatus 20 can be used as a vacuum regulator, and in connection with the operation of the purge valve 16 and an algorithm, can perform large leak detection on the fuel system 10. Such large leak detection could be used to evaluate situations such as when a refueling cap 12*a* is not replaced on the fuel tank 12.

It is understood that volatile liquid fuels, e.g., gasoline, can evaporate under certain conditions, e.g., rising ambient temperature, thereby generating fuel vapor. In the course of cooling that is experienced by the fuel system 10, e.g., after the engine is turned off, a vacuum is naturally created by cooling the fuel vapor and air, such as in the headspace of the fuel tank 12 and in the charcoal canister 18. According to the present description, the existence of a vacuum at the first predetermined pressure level indicates that the integrity of the fuel system 10 is satisfactory. Thus, signaling 22 is used to indicate the integrity of the fuel system 10, i.e., that there are no appreciable leaks. Subsequently, the vacuum relief 24 at a pressure level below the first predetermined pressure level can protect the fuel tank 12, e.g., can prevent structural distortion as a result of stress caused by vacuum in the fuel system 10.

After the engine is turned off, the pressure blow-off 26 allows excess pressure due to fuel evaporation to be vented, and thereby expedite the occurrence of vacuum generation that subsequently occurs during cooling. The pressure blow-off 26 allows air within the fuel system 10 to be released while fuel vapor is retained. Similarly, in the course of refueling the fuel tank 12, the pressure blow-off 26 allows air to exit the fuel tank 12 at a high rate of flow.

At least two advantages are achieved in accordance with a system including the fuel vapor pressure management apparatus 20. First, a leak detection diagnostic can be performed on fuel tanks of all sizes. This advantage is significant in that previous systems for detecting leaks were not effective with known large volume fuel tanks, e.g., 100 gallons or more. Second, the fuel vapor pressure management apparatus 20 is compatible with a number of different types of the purge valve, including digital and proportional purge valves.

Figure 2A:
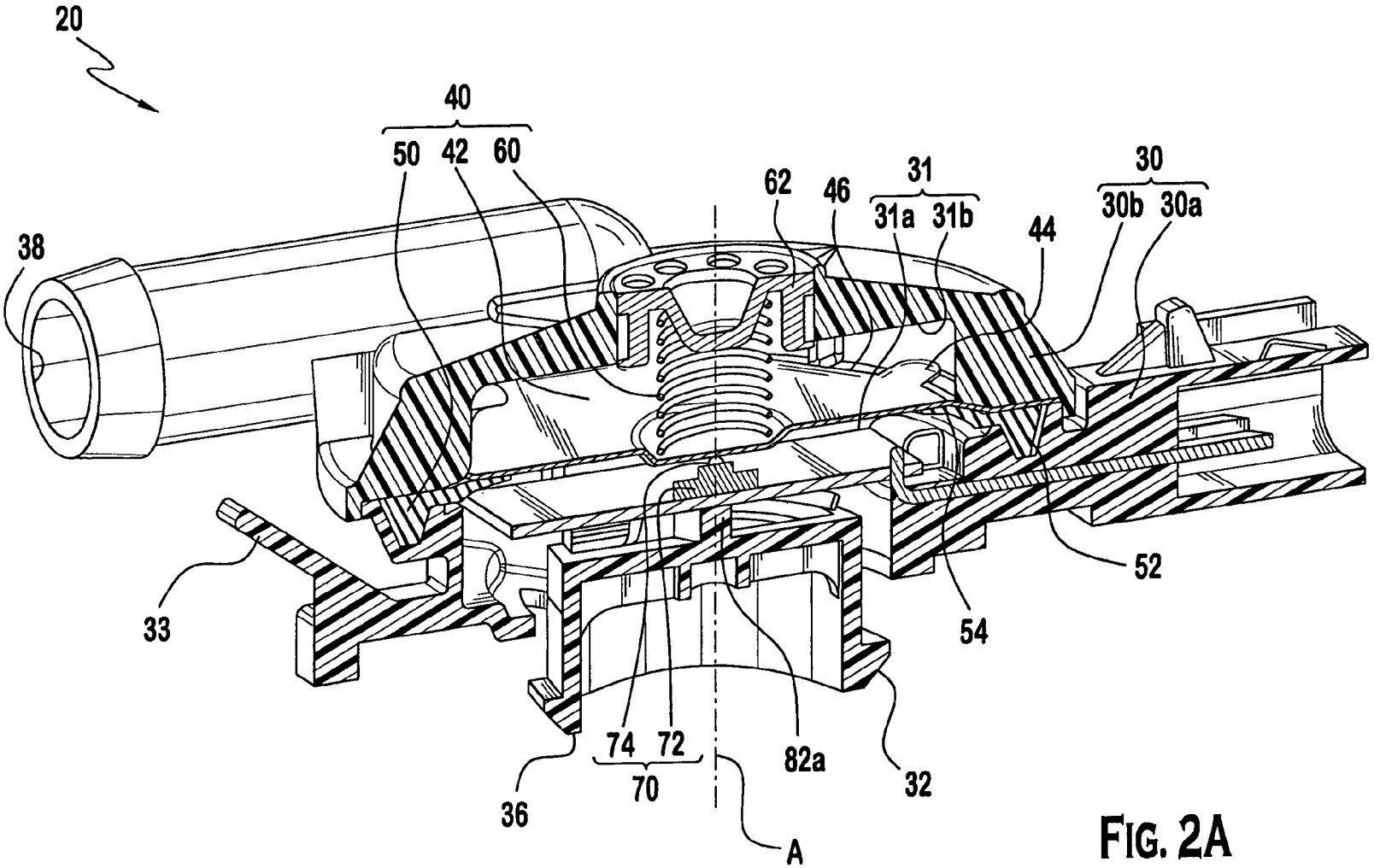
FIG. 2A is a first cross sectional view of the fuel vapor pressure management apparatus illustrated in FIG. 1.

FIG. 2A shows an embodiment of the fuel vapor pressure management apparatus 20 that is particularly suited to being mounted on the charcoal canister 18. The fuel vapor pressure management apparatus 20 includes a housing 30 that can be mounted to the body of the charcoal canister 18 by a "bayonet" style attachment 32. A seal (not shown) can be interposed between the charcoal canister 18 and the fuel vapor pressure management apparatus 20 so as to provide a fluid tight connection. The attachment 32, in combination with a snap finger 33, allows the fuel vapor pressure management apparatus 20 to be readily serviced in the field. Of course, different styles of attachments between the fuel vapor pressure management apparatus 20 and the body of the charcoal canister 18 can be substituted for the illustrated bayonet attachment 32. Examples of different attachments include a threaded attachment, and an interlocking telescopic attachment. Alternatively, the charcoal canister 18 and the housing 30 can be bonded together (e.g., using an adhesive), or the body of the charcoal canister 18 and the housing 30 can be interconnected via an intermediate member such as a rigid pipe or a flexible hose.

The housing 30 defines an interior chamber 31 and can be an assembly of a first housing part 30*a* and a second housing part 30*b*. The first housing part 30*a* includes a first port 36 that provides fluid communication between the charcoal canister 18 and the interior chamber 31. The second housing part 30*b* includes a second port 38 that provides fluid communication, e.g., venting, between the interior chamber 31 and the ambient atmosphere. A filter (not shown) can be interposed between the second port 38 and the ambient atmosphere for reducing contaminants that could be drawn into the fuel vapor pressure management apparatus 20 during the vacuum relief 24 or during operation of the purge valve 16.

In general, it is desirable to minimize the number of housing parts to reduce the number of potential leak points, i.e., between housing pieces, which must be sealed.

An advantage of the fuel vapor pressure management apparatus 20 is its compact size. The volume occupied by the fuel vapor pressure management apparatus 20, including the interior chamber 31, is less than all other known leak detection devices, the smallest of which occupies more than 240 cubic centimeters. That is to say, the fuel vapor pressure management apparatus 20, from the first port 36 to the second port 38 and including the interior chamber 31, occupies less than 240 cubic centimeters. In particular, the fuel vapor pressure management apparatus 20 occupies a volume of less than 100 cubic centimeters. This size reduction over known leak detection devices is significant given the limited availability of space in contemporary automobiles.

A pressure operable device 40 can separate the interior chamber 31 into a first portion 31*a* and a second portion 31*b*. The first portion 31*a* is in fluid communication with the charcoal canister 18 through the first port 36, and the second portion 31*b* is in fluid communication with the ambient atmosphere through the second port 38.

The pressure operable device 40 includes a poppet 42, a seal 50, and a resilient element 60. During the signaling 22, the poppet 42 and the seal 50 cooperatively engage one another to prevent fluid communication between the first and second ports 36,38. During the vacuum relief 24, the poppet 42 and the seal 50 cooperatively engage one another to permit restricted fluid flow from the second port 38 to the first port 36. During the pressure blow-off 26, the poppet 42 and the seal 50 disengage one another to permit substantially unrestricted fluid flow from the first port 36 to the second port 38.

The pressure operable device 40, with its different arrangements of the poppet 42 and the seal 50, may be considered to constitute a bidirectional check valve. That is to say, under a first set of conditions, the pressure operable device 40 permits fluid flow along a path in one direction, and under a second set of conditions, the same pressure operable device 40 permits fluid flow along the same path in the opposite direction. The volume of fluid flow during the pressure blow-off 26 may be three to ten times as great as the volume of fluid flow during the vacuum relief 24.

The pressure operable device 40 operates without an electromechanical actuator, such as a solenoid that is used in a known leak detection device to controllably displace a fluid flow control valve. Thus, the operation of the pressure operable device 40 can be controlled exclusively by the pressure differential between the first and second ports 36,38. Preferably, all operations of the pressure operable device 40 are controlled by fluid pressure signals that act on one side, i.e., the first port 36 side, of the pressure operable device 40.

The pressure operable device 40 also operates without a diaphragm. Such a diaphragm is used in the known leak detection device to sub-partition an interior chamber and to actuate the flow control valve. Thus, the pressure operable device 40 exclusively separates, and then only intermittently, the interior chamber 31. That is to say, there are at most two portions of the interior chamber 31 that are defined by the housing 30.

The poppet 42 is preferably a low density, substantially rigid disk through which fluid flow is prevented. The poppet 42 can be flat or formed with contours, e.g., to enhance rigidity or to facilitate interaction with other components of the pressure operable device 40.

The poppet 42 can have a generally circular form that includes alternating tabs 44 and recesses 46 around the perimeter of the poppet 42. The tabs 44 can center the poppet 42 within the second housing part 30*b*, and guide movement of the poppet 42 along an axis A. The recesses 46 can provide a fluid flow path around the poppet 42, e.g., during the vacuum relief 24 or during the pressure blow-off 26. A plurality of alternating tabs 44 and recesses 46 are illustrated, however, there could be any number of tabs 44 or recesses 46, including none, e.g., a disk having a circular perimeter. Of course, other forms and shapes may be used for the poppet 42.

The poppet 42 can be made of any metal (e.g., aluminum), polymer (e.g., nylon), or another material that is impervious to fuel vapor, is low density, is substantially rigid, and has a smooth surface finish. The poppet 42 can be manufactured by stamping, casting, or molding. Of course, other materials and manufacturing techniques may be used for the poppet 42.

The seal 50 can have an annular form including a bead 52 and a lip 54. The bead 52 can be secured between and seal the first housing part 30*a* with respect to the second housing part 30*b*. The lip 54 can project radially inward from the bead 52 and, in its undeformed configuration, i.e., as-molded or otherwise produced, project obliquely with respect to the axis A. Thus, preferably, the lip 54 has the form of a hollow frustum. The seal 50 can be made of any material that is sufficiently elastic to permit many cycles of flexing the seal 50 between undeformed and deformed configurations.

Preferably, the seal 50 is molded from rubber or a polymer, e.g., nitriles or fluorosilicones. More preferably, the seal has a stiffness of approximately 50 durometer (Shore A), and is self-lubricating or has an anti-friction coating, e.g., polytetrafluoroethylene.

Figure 2B:
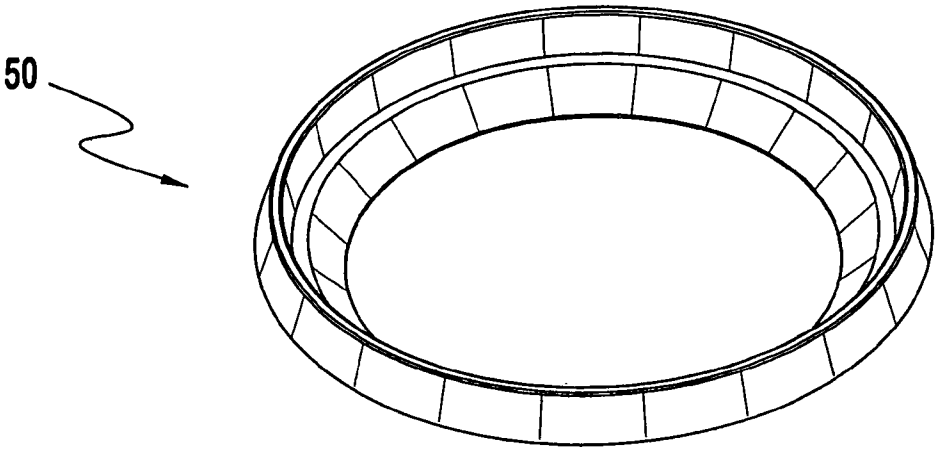
FIG. 2B are detail views of a seal for the fuel vapor pressure management apparatus shown in FIG. 2A.
Figure 2B:
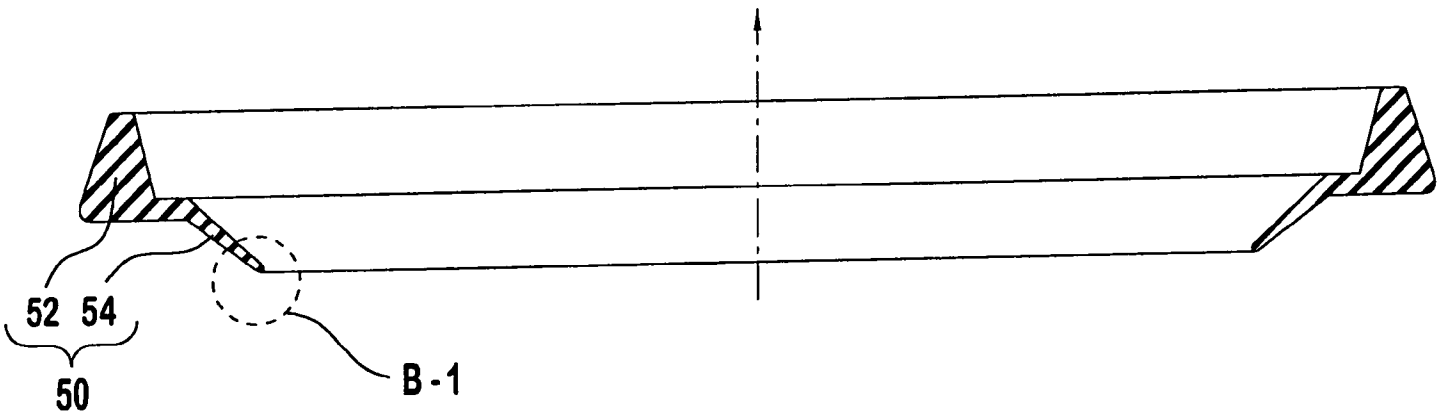
Figure 2B:
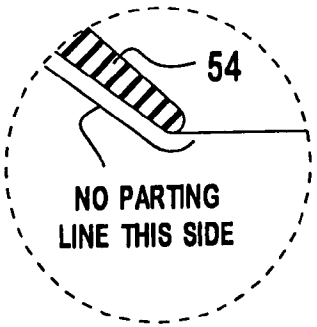

FIG. 2B shows an exemplary embodiment of the seal 50, including the relative proportions of the different features. Preferably, this exemplary embodiment of the seal 50 is made of Santoprene 123-40.

The resilient element 60 biases the poppet 42 toward the seal 50. The resilient element 60 can be a coil spring that is positioned between the poppet 42 and the second housing part 30*b*. Preferably, such a coil spring is centered about the axis A.

Different embodiments of the resilient element 60 can include more than one coil spring, a leaf spring, or an elastic block. The different embodiments can also include various materials, e.g., metals or polymers. And the resilient element 60 can be located differently, e.g., positioned between the first housing part 30*a* and the poppet 42.

It is also possible to use the weight of the poppet 42, in combination with the force of gravity, to urge the poppet 42 toward the seal 50. As such, the biasing force supplied by the resilient element 60 could be reduced or eliminated.

The resilient element 60 provides a biasing force that can be calibrated to set the value of the first predetermined pressure level. The construction of the resilient element 60, in particular the spring rate and length of the resilient member, can be provided so as to set the value of the second predetermined pressure level.

A switch 70 can perform the signaling 22. Preferably, movement of the poppet 42 along the axis A actuates the switch 70. The switch 70 can include a first contact fixed with respect to a body 72 and a movable contact 74. The body 72 can be fixed with respect to the housing 30, e.g., the first housing part 30*a*, and movement of the poppet 42 displaces movable contact 74 relative to the body 72, thereby closing or opening an electrical circuit in which the switch 70 is connected. In general, the switch 70 is selected so as to require a minimal actuation force, e.g., 50 grams or less, to displace the movable contact 74 relative to the body 72.

Different embodiments of the switch 70 can include magnetic proximity switches, piezoelectric contact sensors, or any other type of device capable of signaling that the poppet 42 has moved to a prescribed position or that the poppet 42 is exerting a prescribed force on the movable contact 74.

Figure 4:
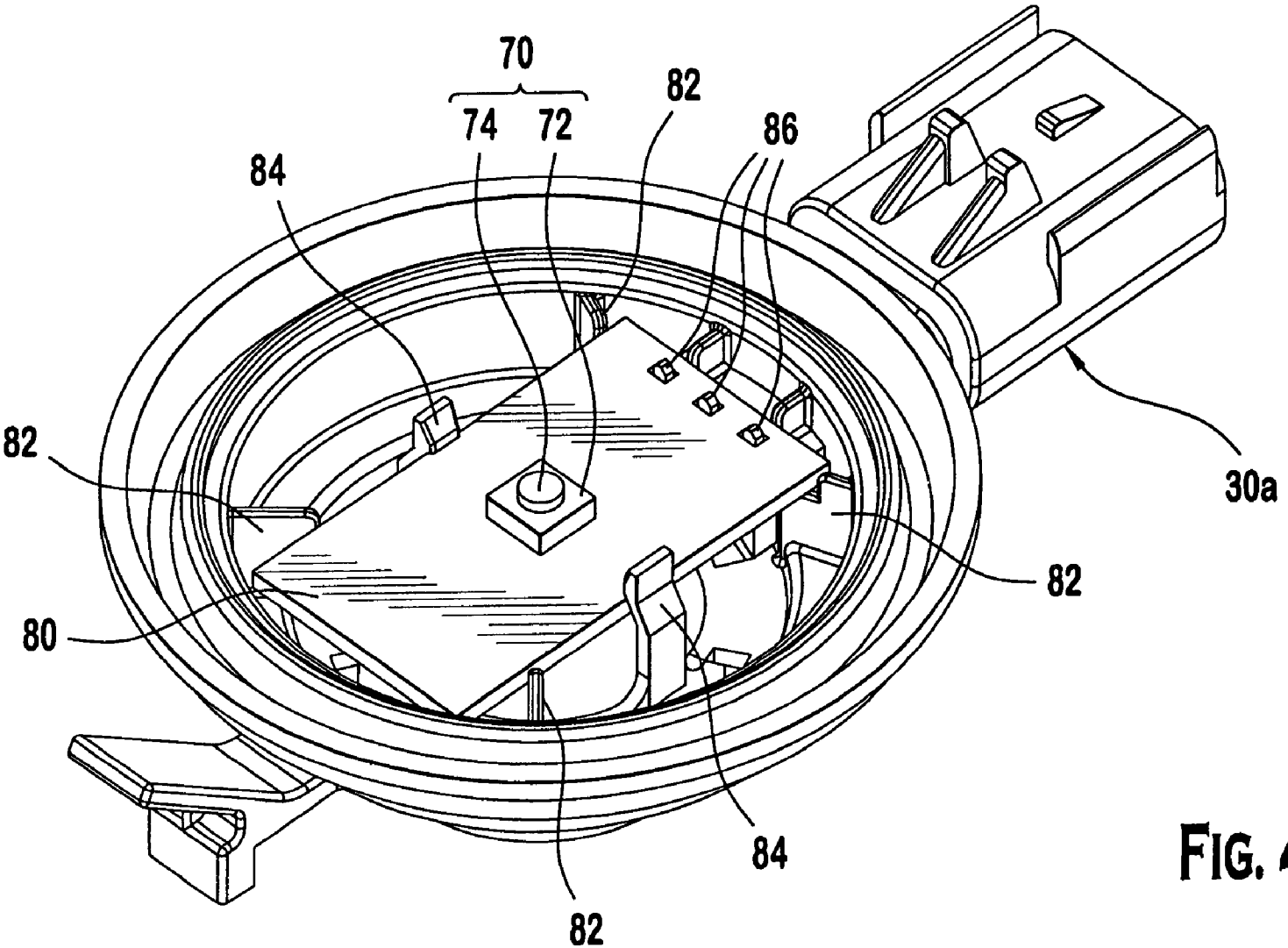
FIG. 4 is a detail view showing a printed circuit board of the fuel vapor pressure management apparatus illustrated in FIG. 1.

Referring additionally to FIG. 4, a printed circuit board 80 is shown mounted on first housing part 30*a*. The printed circuit board 80 supports the switch 70 in the proper position to be actuated by the poppet 42 when the first predetermined pressure level occurs in the vapor pressure canister 18. In turn, referring to FIGS. 4 and 2A, the printed circuit board 80 is supported by a plurality of ribs 82, including a rib 82*a* that is located directly underneath the switch 70, and at least one latch 84 (two are shown in FIG. 4) that secures the printed circuit board 80 against the ribs 82. Electrical communication between the switch 70 and the electronic control unit 76 is via a plurality of conductors 86 (three are shown) and a control circuit that is printed on the printed circuit board 80.

The fuel vapor pressure management apparatus 20 enables different types of the printed circuit board 80 to be placed in the first housing part 30*a*. According to one embodiment, only the electrical lines necessary to connect the stationary and movable contacts 72,74 are printed on the printed circuit board 80. However, according to another embodiment, various functions and levels of logic can be moved from the electronic control unit 76 to the printed circuit board 80 by adding additional control circuit features on the printed circuit board 80. Examples of such features can include a temperature sensor or a latch that is controlled by the switch 70. Also, different sizes of the printed circuit board 80 can be placed in the first housing part 30*a*, provided that the latch(es) 84 can secure the printed circuit board 80 and that the conductors 86 mate with the printed circuit board 80.

The printed circuit board 80 also facilitates additional embodiments for the switch 70. For example, the movable contact 74 can be a domed metal piece that can be pressed, in an over-center or snap motion, by the poppet 42 into a flattened state so as to make electrical contact with the stationary contact 72, which is located on the printed circuit board 80 under the dome of the movable contact 74. An example of such a switch is the Panasonic EVQ.

Figure 2C:
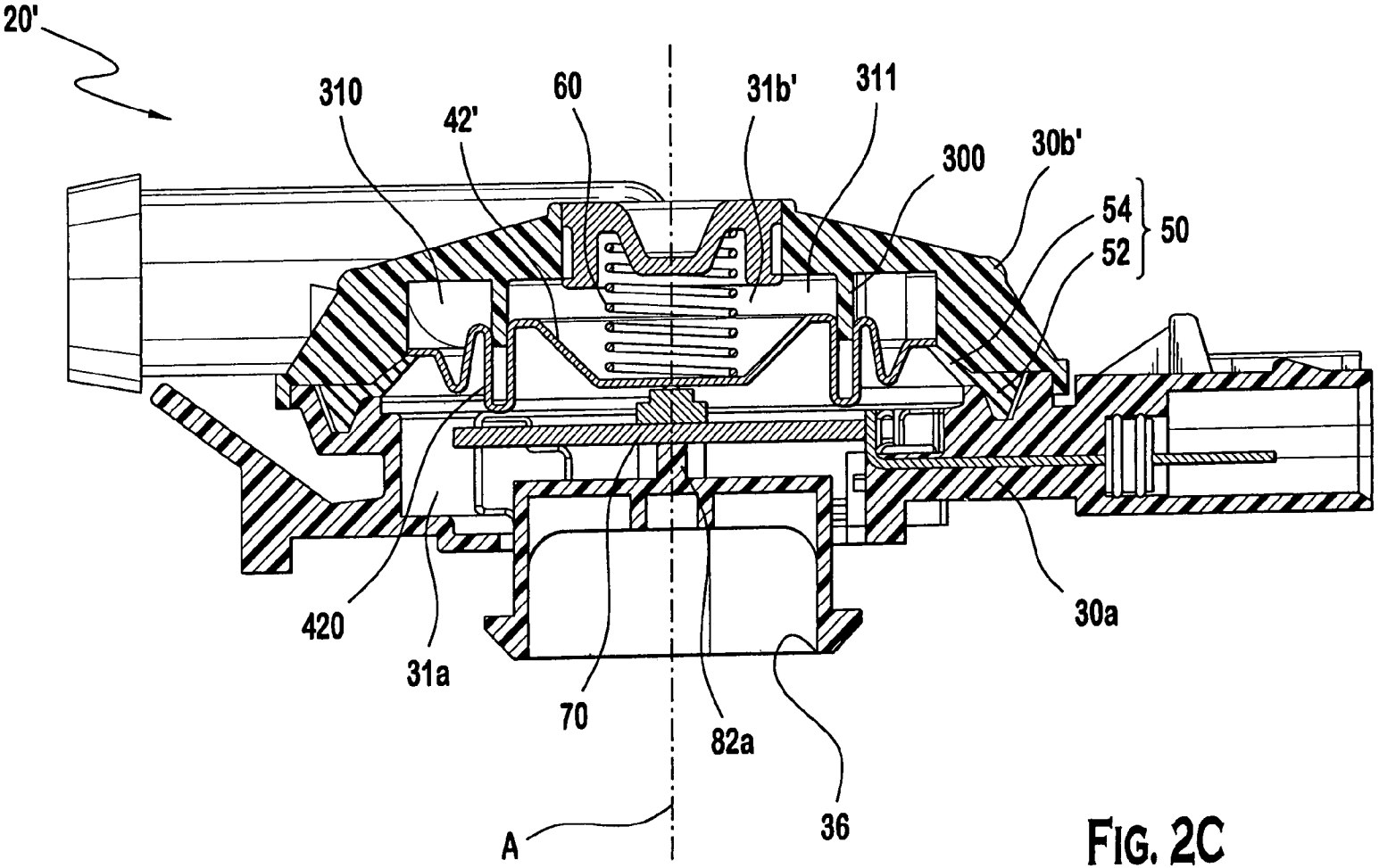
FIG. 2C is a cross sectional view of a fuel vapor pressure management apparatus according to a second embodiment.

Referring now to FIG. 2C, there is shown an alternate or second embodiment, fuel vapor pressure management apparatus 20'. As compared to FIG. 2A, the fuel vapor pressure management apparatus 20' provides an alternative second housing part 30*b*' and an alternate poppet 42'. Otherwise, the same reference numbers are used to identify similar parts in the two embodiments of the fuel vapor pressure management apparatus 20 and 20'.

The second housing part 30*b*' includes a wall 300 projecting into the chamber 31 and surrounding the axis A. The poppet 42' includes at least one corrugation 420 that also surrounds the axis A. The wall 300 and the at least one corrugation 420 are sized and arranged with respect to one another such that the corrugation 420 telescopically receives the wall 300 as the poppet 42' moves along the axis A, i.e., to provide a dashpot type structure. Preferably, the wall 300 and the at least one corrugation 420 are right-circle cylinders.

The wall 300 and the at least one corrugation 420 cooperatively define sub-chambers 310 and 311 of chamber 31*b*'. Movement of the poppet 42' along the axis A causes fluid displacement between sub-chambers 311 and 310. This fluid displacement has the effect of damping resonance of the poppet 42'. A metering aperture (not show) could be provided to define a dedicated flow channel for the displacement of fluid between sub-chambers 310 and 311. As it is shown in FIG. 2C, the poppet 42' can include additional corrugations that can enhance the rigidity of the poppet 42', particularly in the areas at the interfaces with the seal 50 and the resilient element 60.

Returning again to the first embodiment illustrated in FIG. 1, the signaling 22 occurs when vacuum at the first predetermined pressure level is present at the first port 36. During the signaling 22, the poppet 42 and the seal 50 cooperatively engage one another to prevent fluid communication between the first and second ports 36,38.

The force created as a result of vacuum at the first port 36 causes the poppet 42 to be displaced toward the first housing part 30*a*. This displacement is opposed by elastic deformation of the seal 50. At the first predetermined pressure level, e.g., one inch of water vacuum relative to the atmospheric pressure, displacement of the poppet 42 will actuate the switch 70, thereby opening or closing an electrical circuit that can be monitored by an electronic control unit 76. As vacuum is released, i.e., the pressure at the first port 36 rises above the first predetermined pressure level, the elasticity of the seal 50 pushes the poppet 42 away from the switch 70, thereby resetting the switch 70.

Figure 3A:
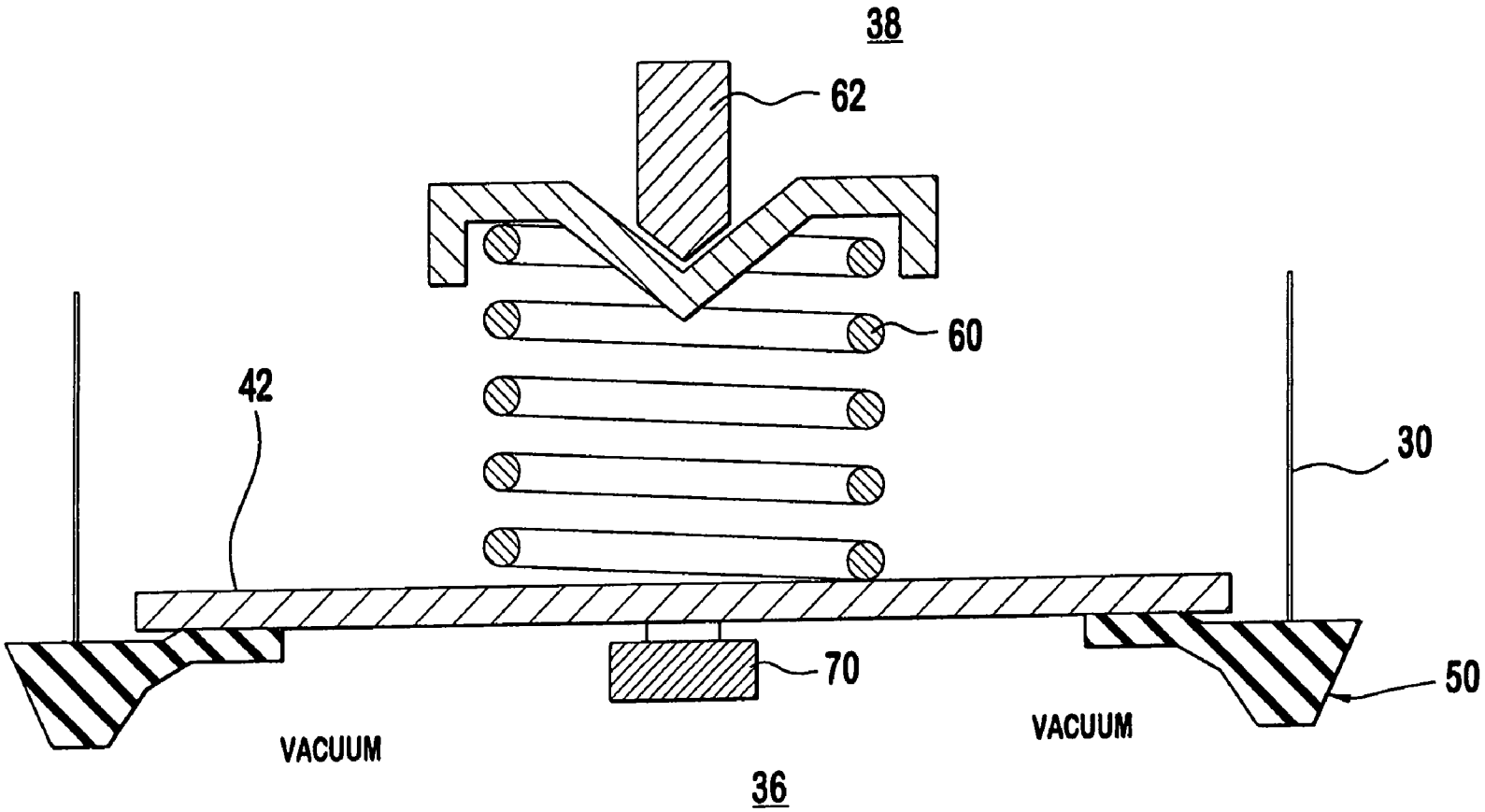
FIG. 3A is a schematic illustration of a leak detection arrangement of the fuel vapor pressure management apparatus illustrated in FIG. 1.

During the signaling 22, there is a combination of forces that act on the poppet 42, i.e., the vacuum force at the first port 36 and the biasing force of the resilient element 60. This combination of forces moves the poppet 42 along the axis A to a position that deforms the seal 50 in a substantially symmetrical manner. This arrangement of the poppet 42 and seal 50 are schematically indicated in FIG. 3A. In particular, the poppet 42 has been moved to its extreme position against the switch 70, and the lip 54 has been substantially uniformly pressed against the poppet 42 such that there is, preferably, annular contact between the lip 54 and the poppet 42.

In the course of the seal 50 being deformed during the signaling 22, the lip 54 slides along the poppet 42 and performs a cleaning function by scraping-off any debris that may be on the poppet 42.

The vacuum relief 24 occurs as the pressure at the first port 36 further decreases, i.e., the pressure decreases below the first predetermined pressure level that actuates the switch 70. At some level of vacuum that is below the first predetermined level, e.g., six inches of water vacuum relative to atmosphere, the vacuum acting on the seal 50 will deform the lip 54 so as to at least partially disengage from the poppet 42.

Figure 3B:
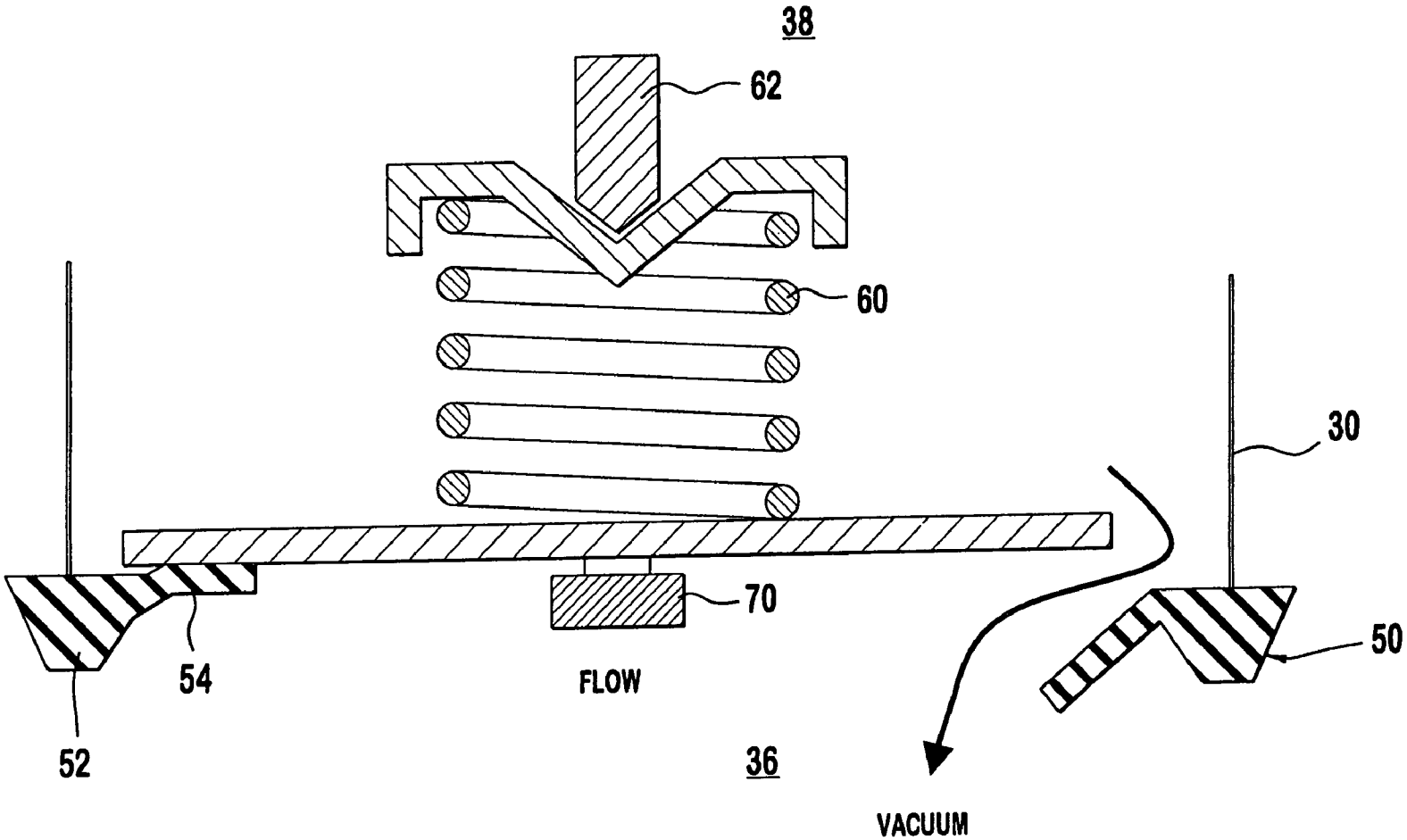
FIG. 3B is a schematic illustration of a vacuum relief arrangement of the fuel vapor pressure management apparatus illustrated in FIG. 1.

During the vacuum relief 24, it is believed that, at least initially, the vacuum relief 24 causes the seal 50 to deform in an asymmetrical manner. This arrangement of the poppet 42 and seal 50 are schematically indicated in FIG. 3B. A weakened section of the seal 50 could facilitate propagation of the deformation. In particular, as the pressure decreases below the first predetermined pressure level, the vacuum force acting on the seal 50 will, at least initially, cause a gap between the lip 54 and the poppet 42. That is to say, a portion of the lip 54 will disengage from the poppet 42 such that there will be a break in the annular contact between the lip 54 and the poppet 42, which was established during the signaling 22. The vacuum force acting on the seal 50. will be relieved as fluid, e.g., ambient air, flows from the atmosphere, through the second port 38, through the gap between the lip 54 and the poppet 42, through the first port 36, and into the canister 18.

The fluid flow that occurs during the vacuum relief 24 is restricted by the size of the gap between the lip 54 and the poppet 42. It is believed that the size of the gap between the lip 54 and the poppet 42 is related to the level of the pressure below the first predetermined pressure level. Thus, a small gap is all that is formed to relieve pressure slightly below the first predetermined pressure level, and a larger gap is formed to relieve pressure that is significantly below the first predetermined pressure level. This resizing of the gap is performed automatically by virtue of the seal 50 cooperating with the poppet 42. Preferably, the poppet 42 is shaped, e.g., includes the corrugation 420, such that the lip 54 moves along the surface of the corrugation 420. Consequently, fluid flow at the interface between the poppet 42 and the lip 54 is "feathered-in," i.e., is progressively adjusted, and is believed to eliminate fluid flow pulsations. Such pulsations could arise due to the vacuum force being relieved momentarily during disengagement, but then building back up as soon as the seal 50 is reengaged with the poppet 42.

Figure 3C:
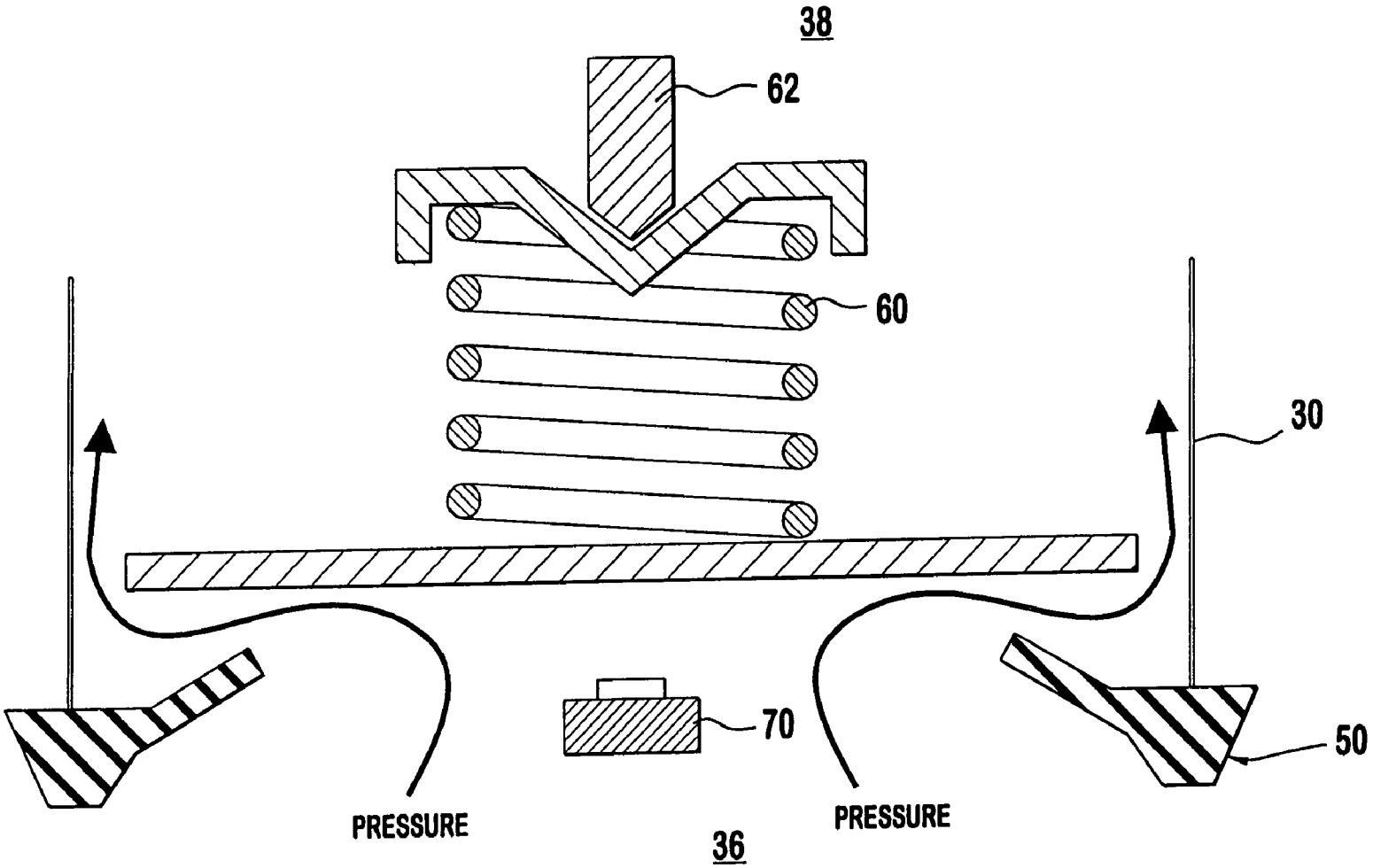
FIG. 3C is a schematic illustration of a pressure blow-off arrangement of the fuel vapor pressure management apparatus illustrated in FIG. 1.

Referring now to FIG. 3C, the pressure blow-off 26 occurs when there is a positive pressure above a second predetermined pressure level at the first port 36. For example, the pressure blow-off 26 can occur when the tank 12 is being refueled. During the pressure blow-off 26, the poppet 42 is displaced against the biasing force of the resilient element 60 so as to space the poppet 42 from the lip 54. That is to say, the poppet 42 will completely separate from the lip 54 so as to eliminate the annular contact between the lip 54 and the poppet 42, which was established during the signaling 22. This separation of the poppet 42 from the seal 50 enables the lip 54 to assume an undeformed configuration, i.e., it returns to its "as-originally-manufactured" configuration. The pressure at the second predetermined pressure level will be relieved as fluid flows from the canister 18, through the first port 36, through the space between the lip 54 and the poppet 42, through the second port 38, and into the atmosphere.

The fluid flow that occurs during the pressure blow-off 26 is substantially unrestricted by the space between the poppet 42 and the lip 54. That is to say, the space between the poppet 42 and the lip 54 presents very little restriction to the fluid flow between the first and second ports 36,38.

According to a third embodiment of the invention, the fuel vapor pressure management apparatus includes both a pressure (e.g., switch 70) and temperature sensor co-located on printed circuit board 80. In this manner, the same microcontroller may be used for both pressure and temperature sensor operations. The temperature sensor is used to monitor the temperature of the fuel vapor after the engine has shut off (as part of a leak detection diagnostic). Additionally, the temperature sensor may be used to perform a diagnostic on the canister purge valve 16 during engine runtime due to its presence within the canister purge valve 16 flow path. Circuit board 80 with temperature and pressure sensor may be located within a pressure operable device (e.g., pressure operable device 40) of a fuel vapor pressure management system, or at another appropriately chosen location in the system. The sensors may be positioned adjacent to the valve types described above, or other valve types.

Figure 5A:
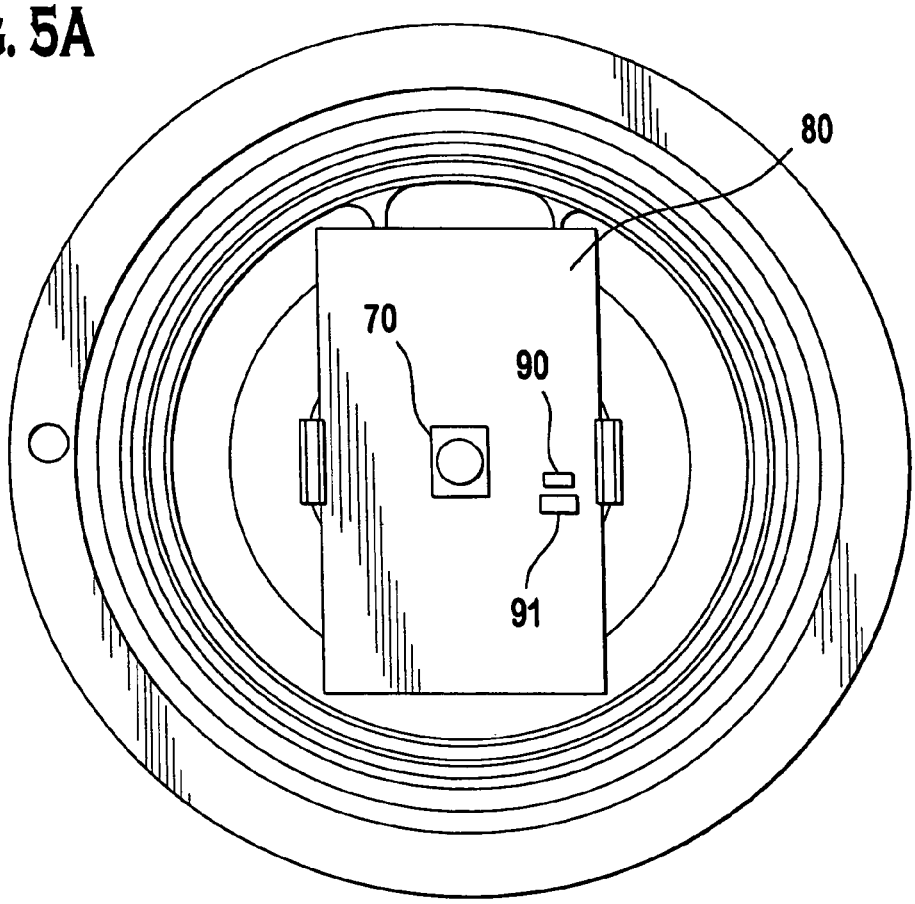
FIG. 5A is a front planar view of a printed circuit board according to a third embodiment of a fuel vapor pressure management apparatus.

The temperature sensor is used to measure fuel vapor temperature after the engine is shutoff. If a change in temperature reading is above a predetermined amount given the engine operating conditions (e.g., ambient temperature, the time period in which the engine was running, etc.), then a natural vacuum should begin to form in the fuel system as the fuel begins to cool (provided there are no leaks in the fuel system). Thus, the temperature sensor is used in connection with switch 70 to perform the leak detection diagnostic as previously discussed. Referring to FIG. 5*a*, a thermistor 90 is selected for measuring temperature of the fuel vapor, although other types of temperature measurement devices may also be used. Thermistor 90 is preferably co-located on circuit board 80 so that the same control circuit may be used to control both pressure and temperature sensing.

The temperature sensor (i.e., thermistor 90) may also be used to determine whether the purge valve 16 is functioning properly. That is, whether the purge valve 16 opens as intended when excessive fuel vapor is detected upstream of the purge valve 16 (i.e., the area of the fuel system including the canister 18 and apparatus 20) so that the system can be purged of excessive fuel vapor. When the purge valve 16 is opened, a vacuum is formed upstream of the purge valve 16. This vacuum will cause pressure operable device 40 to open in a similar manner to that illustrated in FIG. 3B (i.e., fluid flows from chamber 38 to chamber 36) and will also draw fuel vapor within canister 18 towards the engine intake manifold. In a preferred embodiment, thermistor 90 is used since it is already present in the fuel vapor pressure management apparatus for leak detection.

Figure 5B:
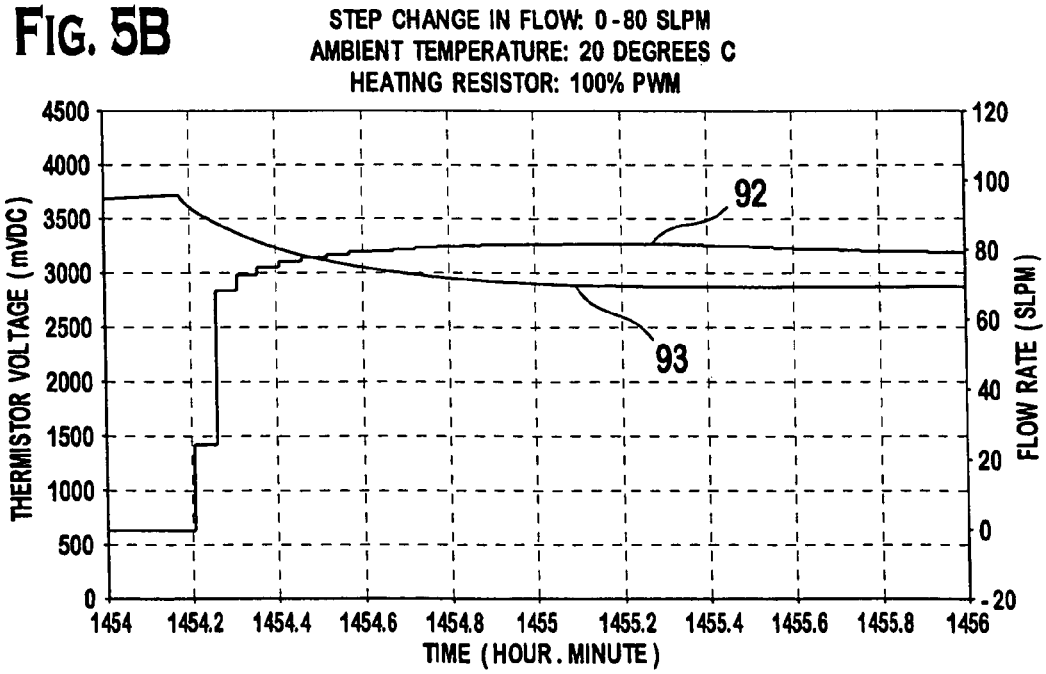
FIG. 5B is a graph plotting the voltage across a thermistor verses time and fluid flow rate over the thermistor verses time.

Fluid flow, and indeed a flow rate may be detected by measuring a temperature change within a locally heated region (i.e., the area surrounding a temperature sensor) based upon the principle of convective cooling. As fuel vapor is drawn towards the engine intake, the heated air immediately surrounding the temperature sensor, e.g., thermistor 90, will be carried off, thereby cooling the sensor. In one embodiment, thermistor 90 is heated prior to the purge valve 16 opening. On command from the engine control unit (ECU), the thermistor 90 is heated and its resulting temperature increase is monitored to ensure that it reaches a predetermined temperature. Once the thermistor 90 has reached this temperature (which may be a function of the engine operating conditions), the ECU will begin to open the purge valve 16. In another embodiment, the thermistor 90 may be heated after the purge valve 16 has opened. In the first case, the thermistor 90 (and fuel vapor immediately surrounding the thermistor 90) will reach temperatures significantly higher than the fuel temperature elsewhere in the fuel system before the valve opens. When the purge valve 16 is opened and fuel vapor is drawn towards the engine intake, the temperature of the thermistor 90 will then decrease rapidly and depreciably. In the second case, a rate of temperature increase may be monitored by the ECU upon initiation of thermistor 90 heating after the purge valve 16 has opened. In either case, a rate of temperature change of the thermistor 90 may be correlated to a fluid flow rate based on field tests conducted under, e.g., various ambient temperature and engine operating conditions to correlate a change in temperature of the thermistor 90 to known flow rates. For example, FIG. 5B is a plot showing a correlation between a change in voltage across a thermistor 93 and a flow rate across the thermistor 92 for an ambient temperature of 20 degrees centigrade. These temperature-flow rate data points may be stored within the ECU and used as benchmarks to estimate an actual flow rate during engine runtime. The calculated flow rate through pressure operable device 40 may then be used to infer whether the purge valve 16 is properly venting excessive fuel vapor.

In a preferred embodiment, a resistor 91 is used to heat thermistor 90. Referring to FIG. 5A, thermistor 90 and resistor 91 are co-located on circuit board 80 with switch 70 so that the existing circuitry in circuit board 80 may also be utilized for thermistor 90 and resistor 91. Resistor 91 is turned off when thermistor 91 is being used during leak detection. This alternative use for thermistor 91 (i.e., resistor 91 "off") may be accommodated by including a mosfet or transistor within the resistor 91 circuitry so that thermistor may be operated in one of two selectable modes, a leak detection mode and a flow rate mode.

In another embodiment, a temperature sensor may include a thermistor without a resistor. In this embodiment, the thermistor is heated by applying a predetermined voltage across it. One advantage to using a resistor to heat the thermistor (rather than the thermistor itself) is that the thermistor need not be of the type that can accept a relatively high voltage during a purge valve diagnostic (for purposes of heating the thermistor) while also being able to accurately measure temperature changes during a leak detection diagnostic.

At least four advantages are achieved in accordance with the operations performed by the fuel vapor pressure management apparatus 20. First, providing a leak detection diagnostic using vacuum monitoring during natural cooling, e.g., after the engine is turned off. Second, providing relief for vacuum below the first predetermined pressure level, and providing relief for positive pressure above the second predetermined pressure level. Third, vacuum relief provides fail-safe purging of the canister 18. And fourth, the relieving pressure 26 regulates the pressure in the fuel tank 12 during any situation in which the engine is turned off, thereby limiting the amount of positive pressure in the fuel tank 12 and allowing the cool-down vacuum effect to occur sooner.

At least two additional advantages are achieved according to the fuel vapor pressure management apparatus of the invention. First, a second sensor may be co-located with a first sensor (e.g., pressure switch) of a fuel vapor pressure management apparatus, thereby providing additional fluid flow and/or temperature data to an ECU without the need to incorporate a significant amount of hardware or system logic modifications for monitoring and evaluating such data. Second, a single sensor may be used to both perform a diagnostic of a canister purge valve during engine runtime and measure fuel vapor temperature in connection with a leak diagnostic when the engine is off.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A method of fuel vapor management for a fuel system of an internal combustion engine, comprising the steps of:

locating a pressure and temperature sensor upstream of a canister;

when the engine is not running, performing a leak detection diagnostic including the steps of detecting a fuel vapor pressure and temperature using the pressure sensor and the temperature sensor, respectively, and determining, based upon the detected pressure and temperature, whether there is a leak in the fuel system; and when the engine is running, performing a purge valve diagnostic including the steps of measuring a temperature using the temperature sensor and based on the measured temperature, diagnosing the performance of the purge valve.

2. The method of claim 1, wherein the performing the purge valve diagnostic includes the step of inferring a presence or absence of fuel vapor flow within the fuel system based on the measured temperature.

3. The method of claim 1, wherein the performing the purge valve diagnostic further includes the step of measuring a plurality of temperatures and based upon the plurality of measured temperatures, inferring a presence or absence of fuel vapor flow within the fuel system.

4. The method of claim 1, wherein the detecting a fuel vapor pressure includes the step of detecting an actuation of the pressure sensor.

5. The method of claim 1, further including the step of providing a housing defining an interior chamber, and the interior chamber containing a valve separating the interior chamber into first and second portions, and disposing the temperature and pressure sensors in the interior chamber.

6. The method of claim 5, further including the step of locating a circuit board within one of the first and second portions, the circuit board including the pressure and temperature sensor.

7. The method of claim 5, wherein the detecting a fuel vapor pressure includes the step of actuating the pressure sensor by movement of the valve.

8. The method of claim 5, further including the steps of providing an external air intake as part of the second portion and a fuel vapor collection canister end as part of the first portion and locating the pressure and temperature sensors in the first portion.

9. The method of claim 1, wherein the purge valve diagnostic step includes measuring a plurality of temperatures over a predetermined time interval.

10. The method of claim 5, further including the steps of:

using a pressure operable device comprising the valve;

locating the pressure and temperature sensors in the first portion; and providing the first portion in continuous fluid communication with the canister and the second portion in continuous fluid communication with a vent port.

11. The method of claim 10, wherein the providing step further includes:

providing a poppet movable along an axis and a seal adapted to cooperatively engage the poppet as the pressure operable device, wherein a first arrangement of the pressure operable device occurs when there is a first negative pressure level in the fuel vapor collection canister relative to the vent port and the seal is in a first deformed configuration, a second arrangement of the pressure operable device permits a first fluid flow from the vent port to the fuel vapor collection canister when the seal is in a second deformed configuration, and a third arrangement of the pressure operable device permits a second fluid flow from the fuel vapor collection canister to the vent port when the seal is in an undeformed configuration, and the pressure sensor signals the first arrangement of the pressure operable device.

12. The method of claim 11, further including the step of orientating the poppet so that it is movable along an axis between a first position, a second position, and an intermediate position between the first and second positions.

13. The method of claim 12, wherein the first and second arrangements of the pressure operable device comprise the poppet in the second position, and the third arrangement of the pressure operable device comprises the poppet in the first position.

14. The method of claim 13, wherein a spring biases the poppet towards the second position.

15. The method of claim 1, wherein the locating step further includes locating a purge valve upstream of an intake manifold so that the purge valve controls the flow of fuel vapor from the canister to the intake manifold.

16. The method of claim 1, further including providing one and only one fluid passageway between the pressure and temperature sensor and the engine intake manifold.

17. A fuel vapor management apparatus for a fuel system of an internal combustion engine, comprising:

a housing located upstream of a canister, purge valve and engine intake manifold and downstream of an external air vent;

a first sensor located in the housing and configured to detect a change in pressure; and a second sensor located in the housing and including a first temperature measuring configuration and a second temperature measuring configuration.

18. The apparatus of claim 17, further comprising:

the housing defining an interior chamber, the interior chamber containing a valve separating the interior chamber into first and second portions; and the first and second sensors are in the interior chamber.

19. The apparatus of claim 18, wherein the valve includes a poppet.

20. The apparatus of claim 19, wherein the poppet is configured to be actuated by a change in pressure between the first and second portions.

21. The apparatus of claim 18, wherein the valve is a pressure operable device.

22. The apparatus of claim 18, wherein the valve includes a poppet configured to engage an elastic seal.

23. The apparatus of claim 17, wherein the first sensor and first temperature measuring configuration are operable during a leak detection diagnostic and the second temperature measuring configuration is operable during a purge valve diagnostic.

24. The apparatus of claim 17, wherein the first temperature measuring configuration has a switch in an open position and the second temperature measuring configuration has the switch configured in a closed position.

25. The apparatus of claim 17, wherein the second sensor includes a resistor.

26. The apparatus of claim 17, wherein the second sensor includes a thermistor.

27. The apparatus of claim 18, wherein the first sensor provides a signal based upon motion of the valve.

28. The apparatus of claim 17, further including a circuit board, the circuit board including the first and second sensor.

29. The apparatus of claim 28, wherein the circuit board is located within a housing that includes a vacuum relief valve.

30. The apparatus of claim 17, wherein the first temperature measuring configuration is adapted for measuring the approximate temperature of fuel vapor throughout the fuel system.

31. The apparatus of claim 17, wherein the second sensor includes a resistor and a resistor circuit and the resistor circuit is configured in an off position in the first measuring configuration whereby the resistor is disabled.

32. The apparatus of claim 17, wherein the second sensor is adapted for measuring a first temperature of fluid in its immediate vicinity when the headspace has a second temperature and the first temperature is substantially greater than the second temperature.

33. The apparatus of claim 17, wherein the second sensor includes a heating resistor and a resistor circuit configured in an on position in the second measuring configuration whereby the resistor is enabled.

34. The apparatus of claim 18, further including:

a pressure operable device comprising the valve;

the pressure and temperature sensors are disposed in the first portion; and the first portion is in continuous fluid communication with a fuel vapor collection canister and the second portion is in continuous fluid communication with a vent port.

35. The apparatus of claim 34, wherein the pressure operable device further includes:

a poppet movable along an axis and a seal adapted to cooperatively engage the poppet, wherein a first arrangement of the pressure operable device occurs when there is a first negative pressure level in the fuel vapor collection canister relative to the vent port and the seal is in a first deformed configuration, a second arrangement of the pressure operable device permits a first fluid flow from the vent port to the fuel vapor collection canister when the seal is in a second deformed configuration, and a third arrangement of the pressure operable device permits a second fluid flow from the fuel vapor collection canister to the vent port when the seal is in an un-deformed configuration, and wherein the pressure sensor signals the first arrangement of the pressure operable device.

36. The apparatus of claim 35, wherein the poppet is configured to move along an axis between a first position, a second position, and an intermediate position between the first and second positions.

37. The apparatus of claim 36, wherein the first and second arrangements of the pressure operable device comprise the poppet in the second position, and the third arrangement of the pressure operable device comprise the poppet in the first position.

38. The method of claim 37, wherein a spring biases the poppet towards the second position.

39. The apparatus of claim 17, wherein the first and second sensors reside on a common circuit board.

40. The apparatus of claim 17, wherein the first and second sensors are positioned adjacent to a valve.

* * * * *